US005374107A

United States Patent [19]

Schnitzler

[11] Patent Number: 5,374,107

[45] Date of Patent: Dec. 20, 1994

[54] HANGING CHAIR

[76] Inventor: Robin K. Schnitzler, 20 Bridge St., Lambertville, N.J. 08580-2119

[21] Appl. No.: 35,175

[22] Filed: Mar. 22, 1993

[51] Int. Cl.[5] ..... A47D 13/10

[52] U.S. Cl. ..... 297/273; 297/276; 297/280; D6/347

[58] Field of Search ..... 297/273, 276, 277, 280, 297/281, 282, 452.63, 452.64; D6/347, 387, 386; 472/118

[56] References Cited

U.S. PATENT DOCUMENTS

| | | | |
|---|---|---|---|
| 135,018 | 1/1873 | Strassle | 297/276 |
| D. 183,284 | 7/1958 | Link | D6/347 X |
| 212,514 | 2/1979 | Ryan | 297/280 |
| D. 260,460 | 9/1981 | Osterman | D6/347 |
| D. 281,206 | 11/1985 | Halsall | D6/347 |
| 1,066,991 | 7/1913 | Brogley | 297/276 |
| 1,189,393 | 7/1916 | Shaw | 297/276 |
| 1,839,579 | 1/1932 | Murray | 297/276 X |
| 2,600,675 | 6/1952 | Nelson | 297/276 |

FOREIGN PATENT DOCUMENTS

| | | | |
|---|---|---|---|
| 8409 | 3/1893 | United Kingdom | 297/276 |

*Primary Examiner*—Laurie K. Cranmer
*Attorney, Agent, or Firm*—Kenneth P. Glynn

[57] ABSTRACT

The present device is directed to a hanging chair, which may also be characterized as a swing. The chair utilizes a plurality of elongated lateral crosspieces. Some of these form a base or bottom and some form a back to the chair. All have orifices at opposite ends. There are also a plurality of elongated side crosspieces which likewise have orifices at opposite ends and one end of these crosspieces are aligned or interweaved or otherwise arranged with the lateral crosspieces forming the back of the chair. There is optionally at least one front crosspiece likewise having orifices at opposite ends. A flexible cord passes through at least some of the orifices so as to align and hold in place both the lateral crosspieces and the side crosspieces, as well as the front crosspieces so as to conform the pieces into a hanging chair arrangement. The suspension is achieved by one and the same rope or cord which passes through the orifices in the aforesaid pieces so that there is direct suspension. Spacers are used between the forward ends of the side crosspieces and an optional center stack of spacers may be included to create a divider for user or users. The critical feature of the present invention is that the suspension vectors, that is, the forces from suspension, pass directly rather than indirectly through the rope or cord which holds the crosspieces in place.

21 Claims, 2 Drawing Sheets

HANGING CHAIR

BACKGROUND OF THE INVENTION

1. Field of the Invention

The present invention is directed to a hanging chair, and more particularly to a hanging chair which may be used as a suspended seat, hanging from a permanently fixed support or from a movable support. The invention may alternatively be used for a swing, for children or for adults.

2. Information Disclosure Statement

The art of hanging chairs and swings has been around for more than a century and there is a significant variety of designs and arrangements for hanging chairs and swings. The following prior art represents a chronology as well as what is believed to be the closest prior art to the present invention:

U.S. Pat. No. 490,287, issued to F. J. House and F. X. Martin in 1893 describes a hammock which is made of a series of lateral crosspieces which are interwoven by outside wires which form loops.

U.S. Pat. No. 790,292 issued to M. W. Yeager in 1905 shows a suspended chair or swing which has lateral crosspieces which are attached to a flat piece of metal stock or bar. Fastening is achieved by bolting or otherwise permanently and rigidly fastening the slats or lateral crosspieces to the metal bars or straps.

U.S. Pat. No. 1,500,338 issued in 1924 to F. W. Shuman describes a suspended seat which includes lateral crossmembers with spacers therebetween and a flexible rod passing therethrough. The rod is bolted at both ends to hold the pieces together and a separate arm piece has eyehooks to which the suspension means is attached. Contrary to the present invention, this invention does not utilize the suspension means as the connection means for holding the slats together.

U.S. Pat. No. 2,048,110 issued to W. H. Fry, in 1936, describes a suspended seat or swing utilizing lateral crosspieces which are nailed to a main frame. The main frame includes a rod which passes from the main frame from arms of the chair which are subsequently attached to suspension chains.

U.S. Pat. No. 4,192,524 issued in 1980 describes a rocking chair which has non structural support means which are blocks having a plurality of orifices through which rope is threaded back and forth so as to support the blocks. The rocking chair is not suspended and the ropes are not used to maintain lateral crosspieces nor are the ropes used for suspension.

U.S. Pat. No. 3,829,086 issued to Lelong in 1974 describes an elaborate figure eight swing which includes as shown in FIG. 2 a series of looped ropes to maintain tubular members in a lateral configuration. However, these ropes do not pass through orifices in the lateral crosspieces nor are they used for the suspension system.

U.S. Pat. No. 4,244,622 issued to Simpson in 1981 describes a hanging chair wherein a series of lateral crossmembers are connected with spaces by means of a rope or cord looped therethrough. However, there are spacers which extend at right angles to the crosspieces and at the opposite ends of these spacers, suspension means is passed through. In other words, the rope which maintains the lateral crosspieces together is not the rope which is used for suspension, nor is there direct suspension from the orifices in the lateral crosspieces upwardly.

Not withstanding the above prior art, there is no teaching or suggestion that a suspended chair or swing could be achieved by using a single alignment or rope or cord to both hold lateral crosspieces in place and to suspend them for hanging.

SUMMARY OF THE INVENTION

The present invention is directed to a hanging chair, which may also be characterized as a swing. The chair utilizes a plurality of elongated lateral crosspieces. Some of these form a base or bottom and some form a back to the chair. All have orifices at opposite ends. There are also a plurality of elongated side crosspieces which likewise have orifices at opposite ends and one end of these crosspieces are aligned or interweaved or otherwise arranged with the lateral crosspieces forming the back of the chair. There is optionally at least one front crosspiece likewise having orifices at opposite ends. A flexible cord passes through at least some of the orifices so as to align and hold in place both the lateral crosspieces and the side crosspieces, as well as the front crosspieces so as to conform the pieces into a hanging chair arrangement. The suspension is achieved by one and the same rope or cord which passes through the orifices in the aforesaid pieces so that there is direct suspension. Spacers are used between the forward ends of the side crosspieces and an optional center stack of spacers may be included to create a divider for user or users. A single rope or cord may be utilized so that it goes down up back down and up again doing one side and then the other or two or more pieces of rope may be used. The critical feature of the present invention is that the suspension vectors, that is, the forces from suspension, pass directly rather than indirectly through the rope or cord which holds the crosspieces in place.

BRIEF DESCRIPTION OF THE DRAWINGS

The present invention will be more fully understood when the specification herein is taken into conjunction with the drawings appended hereto, wherein.

DETAILED DESCRIPTION OF THE PRESENT INVENTION

It is an objective of the present invention to eliminate complex suspension systems and complex physical connection of hanging chairs and swings as is known in the prior art.

It is another object of the present invention to develop a hanging chair or swing whereby the forces of suspension pass from the points of hanging directly into the lateral crosspieces which form the body of the hanging chair.

It is an object of the present invention to create chairs which are superior to prior art chairs with respect to the components required, the ease of construction and the ability to allow a user to self assemble such a chair.

Figure 1:
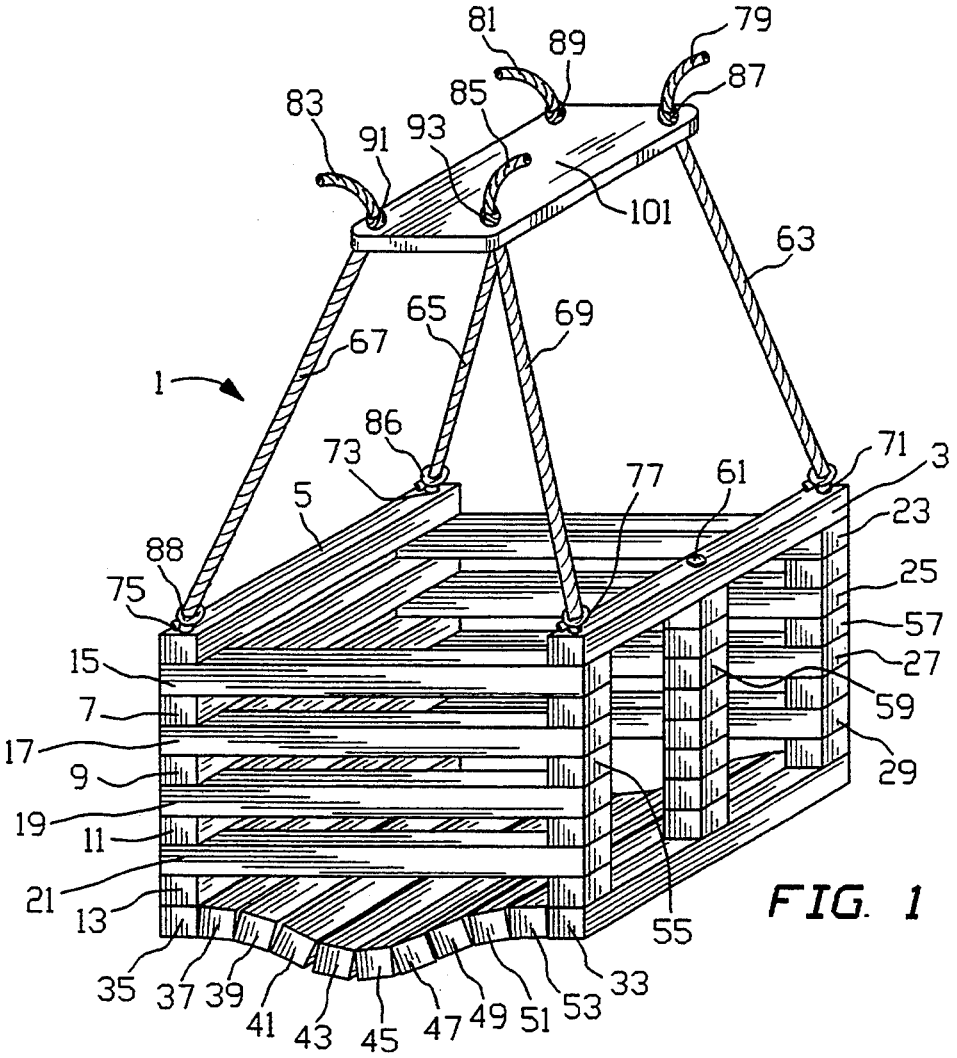
FIG. 1 shows a side oblique view of one embodiment of a invention hanging chair.

Referring now to FIG. 1, there is shown a side oblique view of a hanging chair of the present invention. It should be noted that this hanging chair has a straight back rather than a curved back, although, with some flexibility with respect to the drilling of the orifices and the attachment means, there may well be embodiments whereby the back will slope to some degree or may otherwise contour or curve when it is sat in. Further, the materials of construction are not critical and, thus, wood, plastic or metal could be used. However, in the all of the most preferred embodiments, the hanging chair of the present invention are constructed of hard woods to create a natural presentation and beauty as well as sound structural design.

FIG. 1 shows present invention hanging chair 1 with a plurality of lateral crosspieces, 5,7,9,11,13,35,37,39,41,43,45,47,49,51,53, and 33. Each of the crosspieces have a first end and a second end having at least one orifice such as orifice 73 and orifice 75 shown in typical lateral crosspiece member 5. These orifices are near the ends, as shown and are substantially parallel to the ends of the crosspieces. In fact, by substantially parallel to the ends of the crosspieces, it is assumed that the crosspieces are cut at right angles. However, within the scope of the present invention would be those embodiments where the crosspieces are not cut at right angles, at which case the orifices are drilled or formed at right angles to the elongated direction of the lateral crosspieces. A portion of the plurality of lateral crosspieces, namely crosspieces 5,7,9,11, and 13 form a back of chair 1. Another portion of the crosspieces, namely crosspiece 35,37,39,41,43,45,47,49,51,53, and 33 form a base or bottom of chair 1.

Figure 2:
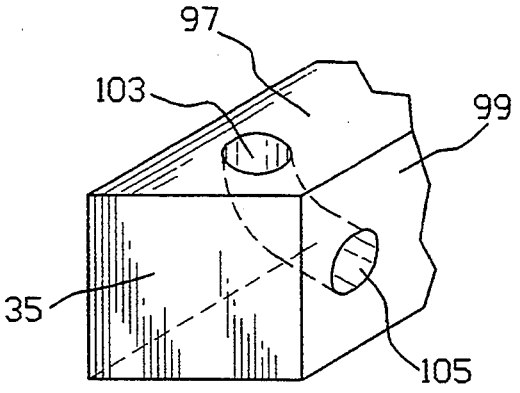
FIG. 2 shows a side oblique view of one end of a corner piece of the FIG. 1 present invention chair.

A plurality of elongated side crosspieces, 15,17,19,21,23,25,27, and 29, are broken into two groups, one group forming the left side of the chair or seat 1, and the other forming the right side thereof. Typical is the arrangement whereby these side crosspieces are interwoven by the back portion lateral crosspieces. Thus, they are stacked in the form of crosspieces 5,15,7,17,9,19,11,21,13, and 35. This shows an alternating back, side interleafing which creates the configuration in FIG. 1. Toward the front of the side crosspieces are spacers such as 55 and 57 which have orifices therein for passing the suspension means therethrough. Thus rope 67 passes downwardly through orifice 75 and further downwardly through all of the orifices sequentially in the stacked crosspieces and, referring now to FIG. 2, makes a turn so as to pass through orifices in the bottom crosspieces 37 through 53. Again, looking at both FIGS. 1 and 2, crosspiece 35 has orifices 103 and 105 in top surface 97 and frontwardly facing surface 99, respectively, so as to guide the rope accordingly. Once the rope 67 passes through the bottom pieces, it makes a similar but opposite traverse in crosspiece 33 so as to pass upwardly through the spacers and the other ends of the side crosspieces 21, 19, 17 and 15. Then section 69 of rope 67 passes upwardly through orifice 93 to end 85. Likewise, opposite end of rope 67 passes through orifice 91 and is shown at end 83. To retain the crossmembers in place, a knot 88 or other holding means, such as a clip or fastener, or other pinching or holding means may be used to keep the back lateral crosspieces and the back of the side pieces from moving upwardly. Likewise, not shown, under front crosspiece free above, for example, crossmember 23 and crossmember 15. Similar holding or fastening means may be attached. These would be below optional front piece 3 so that front piece 3 may be raised upwardly and downwardly along rope section 69 and rope 63.

A stack of hexagonal spacers such as spacer 59 is affixed to the center of bottom lateral crosspiece 33 and stretchable or removable attachment means 61 holds front crosspiece 3 in place except when it may be removed or stretched to lift upwardly for putting a child therein.

Paralleling rope 67 is rope 63 which goes downwardly through orifice 71 down through the front portions of side crosspieces 23,25,27,29, and the spacers therebetween, and down through that side of the lateral crosspieces forming the bottom and upwardly through the back lateral crosspieces and the back portion of the side crosspieces, finally exiting at orifice 73 with knot 86 and upwardly through orifice 89 and board 101 to terminate at end 81. Likewise, at the other end of rope 63, it passes through orifice 87 of board 101 and terminating at 79. Board 101 is representative of a suspension alignment device, but may also represent the top most portion of a frame member or otherwise, and rope ends 83,85,81, and 79 may be attached by any known means such as tying, clamping, looping and weaving or otherwise.

Figure 3:
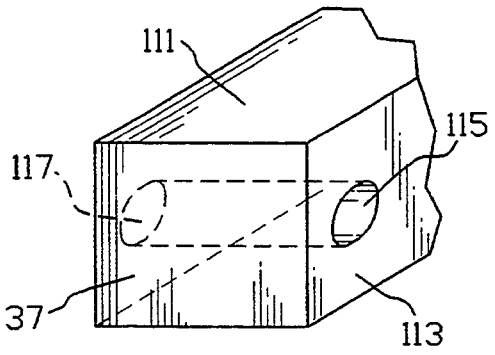
FIG. 3 shows a partial side oblique view of a bottom lateral crosspiece utilized in the FIG. 1 chair of the present invention; and, FIG. 4 shows a side oblique view of an alternative embodiment present invention hanging chair; and, FIG. 5 shows an alternative embodiment unistructurally formed crosspiece with spacer.

Referring to FIG. 3, there is shown a typical cross section of a lateral crossmember 37. Here, orifice 117 passes in and out at orifice 115 at right angles to the lateral direction of surface 111 and surface 113, as shown. Obviously, when such crosspieces are utilized in the bottom, the orifice is horizontal. Likewise, when the crosspieces are used for the backs, the orifices are vertical.

Figure 4:
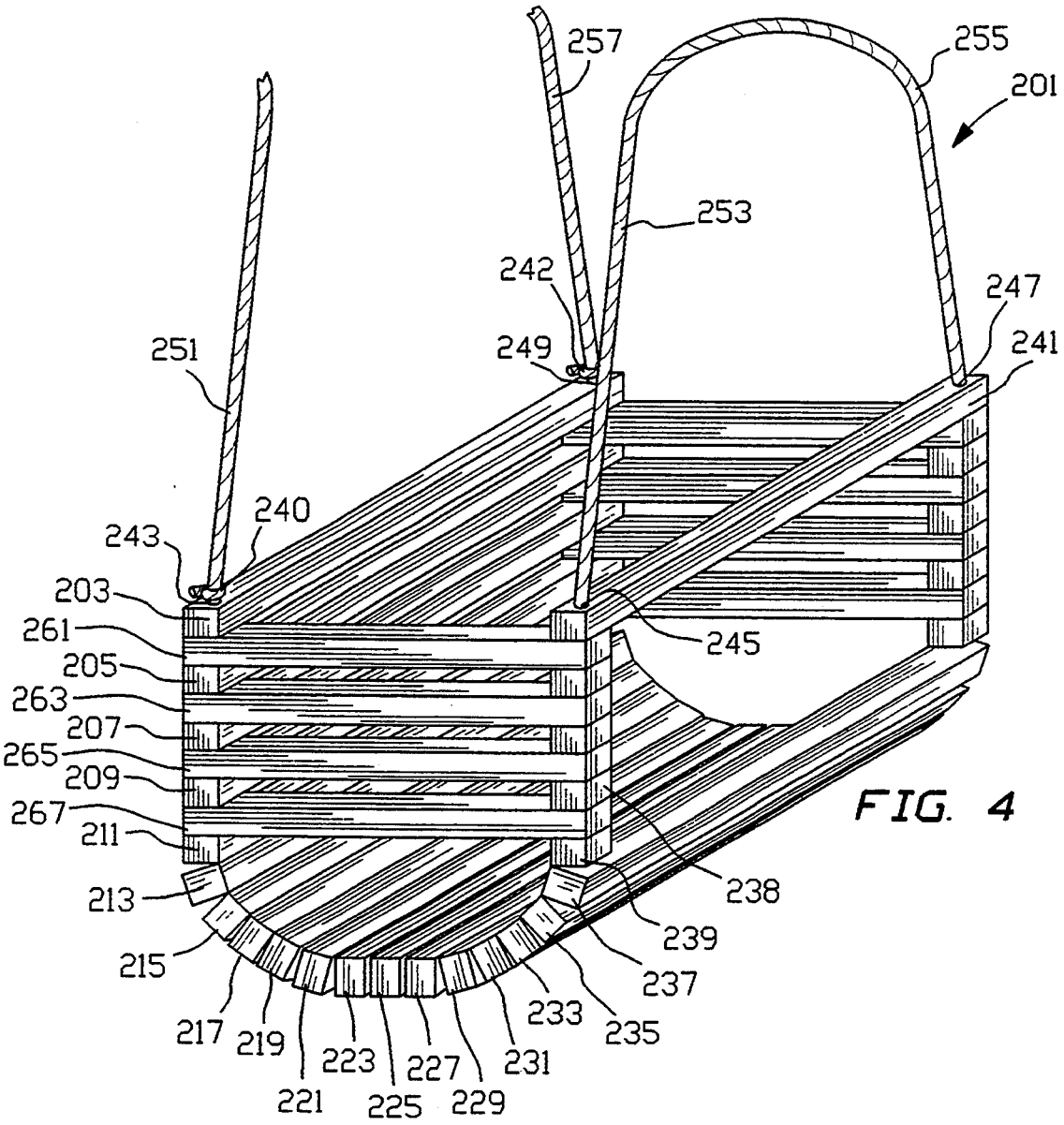

Referring now to FIG. 4, there is shown a side oblique view of present invention hanging chair 201. This includes lateral crosspieces 203, 205, 207, 209, 211, 215, 217, 219, 221, 223, 225, 227, 229, 231, 233, 237, and 239 also, front lateral crosspiece 241 is as shown. Additionally, side crosspieces 261, 263, 265, and 267 form the right side of chair 201 and are interleafed among the lateral side pieces which form the back of chair 201, as shown. Additionally, left side pieces 269, 271, 273 and 275 are interleafed with the back forming lateral side pieces 203, 205, 207 and 209 as shown. Unlike seat 1 shown in FIG. 1, this seat does not have any special orifices going through any of the crossmembers, such as in crossmembers 33 and 35 of FIG. 1, but all orifices are at right angles to both the elongated direction of each crosspiece as well as to the flat surfaces thereof. Thus, while the back and side crosspieces are in a vertical plane, the bottom crosspieces are suspended much like a cable on a suspended bridge to form the bottom of seat 201, as shown. Additionally, rope 251 passes through orifice 243 and on downwardly until the bottom thereof and then forward through the base lateral crosspieces and upwardly through spacers such as spacer 239 and upwardly through orifice 245 of front crosspiece 241. It advances upwardly as rope section 253 and then downwardly as rope 255 and enters orifice 247 as shown. It passes through all of the left side cross pieces and that end of the lateral cross pieces and comes up at orifice 249 terminating at rope section 257 for attachment over a pole or other suspension frame, as desired. The ends of rope sections 251 and 257 could be tied together and all of the suspension sections could be attached to a single attachment means such as a very large hook. Preferably, however, a spacer board is used to balance and prevent the hanging seat 201 from shifting or tilting and a frame with more than one attachment point would be appropriate for this purpose. Also, stop mechanisms such as clamps 240 and 242 may be used to prevent the riding up of the lateral cross pieces along the rope, as shown. Front crossmember 241 may have knots or other fastening members below it and may be raised up to some point for access, or, alternatively, may be stationary.

Figure 5:
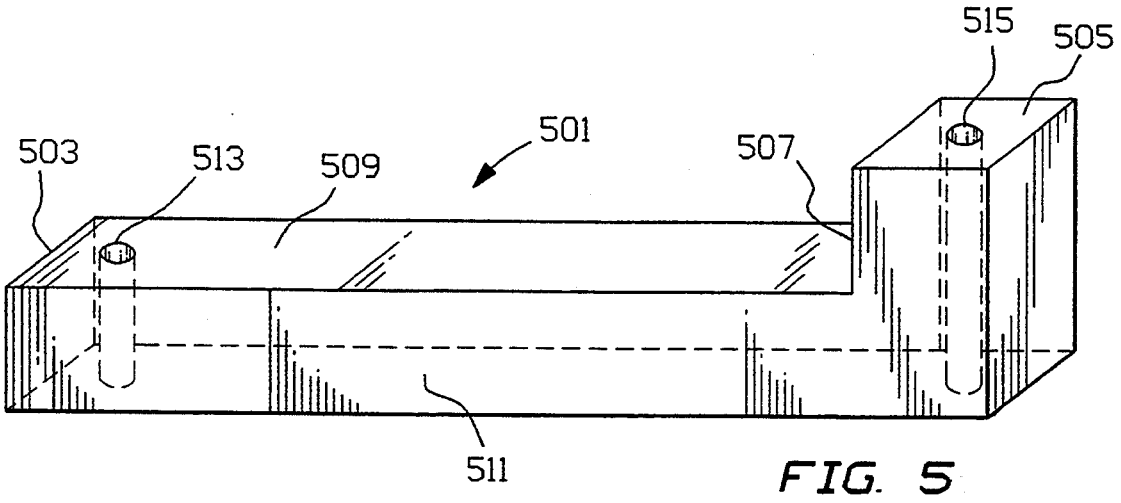

FIG. 5 shows a side view of an alternative crosspiece which includes a spacer. Referring to FIG. 5, crosspiece 501 is unistructurally formed and includes elongated member 511 with orifice 513 formed at end 503 in top 509. At the opposite end is spacer block 507 with orifice 515 formed in top 505. Referring back to FIG. 4, for example, crosspiece 501 could replace crosspiece 267 and spacer 238 of FIG. 4 so as to eliminate the need for separate spacers. Crosspiece 501 may be formed of wood or any other material as discussed above in connection with the other crosspieces described herein.

While the crossmembers are shown to be interleafed in alternating fashion, it should be noted that they need not be directly alternating and, for example, only one or two side cross pieces could be used. This would result in a "solid" type of back instead of one with spacers there between. Likewise, only a smaller number of lateral crossmembers could be used in the back and more on the sides to fill in the sides and leave an open back. Now that the invention has been more fully disclosed, various embodiments are left to the artisan to create a particular structure within the scope of the present invention.

Obviously, numerous modifications and variations of the present invention are possible in light of the above teachings. For example, the crosspieces may be square, rectangular, round, trapezoidal, half round, quarter round or of any other workable cross-section. The ends may be cut at any angle, rounded or otherwise shaped. The spacers may be separate pieces or formed as part of the crosspieces. Liners may be inserted into the orifices as desired. Center spacers (e.g. spacer 59 of FIG. 1) may be one or more pieces and may be elongated and/or otherwise shaped. Other changes should now be evident to the artisan. It is therefore understood that within the scope of the appended claims, the invention may be practiced otherwise than as specifically described herein.

What is claimed is:

1. A hanging chair, which comprises:

(a) a plurality of elongated lateral crosspieces, each having a first end and a second end and having at least one orifice passing through each of said crosspieces near and substantially parallel to said first end and at least one orifice passing through each of said crosspieces near and substantially parallel to said second end, a plurality of said crosspieces forming a back of said chair and another plurality of said crosspieces forming a base of said chair;

(b) a plurality of elongated side crosspieces having a first end and a second end and having at least one orifice passing through each of said side crosspieces near and substantially parallel to said first end and at least one orifice passing through each of said side crosspieces near and substantially parallel to said second end, a plurality of said elongated side crosspieces forming a left side of said chair and a plurality of said elongated side crosspieces forming a right side of said chair;

(c) at least one flexible cord passing through at least some of said orifices, said at least one flexible cord simultaneously acting to hold said crosspieces in alignment and suspension and acting as the suspension means for hanging said chair; and, (d) a plurality of spacers located between said side crosspieces forming said left side at a front located end thereof, and a plurality of spacers located between said side crosspieces forming said right side at a front located end thereof, said spacers having at least one orifice therethrough and in alignment with orifices of said side crosspieces;

wherein said lateral crosspieces and side crosspieces are arranged in the shape of a chair with their orifices aligned with one another and with said at least one flexible cord passing through at least some of said orifices and wherein said at least one flexible cord includes one flexible cord which passes down and through the orifices at one end of said lateral crosspieces forming said back and the orifices at one end of the left side forming portion of said side crosspieces, and through the orifices at one end of the lateral crosspieces forming said bottom, and up through the orifices at the second end of said left side forming portion of said side crosspieces, and then down through the orifices at one end of said right side forming portion of said side crosspieces, through the orifices at the second end of the lateral crosspieces forming the bottom and up through the orifices at the second end of said right side forming portion of said side crosspieces and the orifices at the second end of the lateral crosspieces forming the back.

2. The hanging claims of claim 1 wherein said chair further includes:

at least one front crosspiece having a first end and a second end and having at least one orifice passing therethrough near and substantially parallel to said first end and at least one orifice passing therethrough near and substantially parallel to said second end.

3. The hanging chair of claim 2 wherein said at least one front crosspiece is located atop said side crosspiece and is adapted to be glidable vertically along said flexible cord to enhance chair access by a user.

4. The hanging chair of claim 1 wherein said lateral crosspieces forming said back of said chair and said side crosspieces are interleaved in alternating fashion to form an open lattice of crosspieces on said back and said sides of said chair.

5. The hanging chair of claim 1 wherein said spacers are separate pieces.

6. The hanging chair of claim 1 wherein said spacers are integrally formed with one or more of said side crosspieces.

7. The hanging chair of claim 1 wherein said crosspieces are made of one or more materials selected from plastic, wood and metal.

8. A hanging chair, which comprises:

(a) a plurality of elongated lateral crosspieces, each having a first end and a second end and having at least one orifice passing through each of said crosspieces near and substantially parallel to said first end and at least one orifice passing through each of said crosspieces near and substantially parallel to said second end, a plurality of said crosspieces forming a back of said chair and another plurality of said crosspieces forming a base of said chair;

(b) a plurality of elongated side crosspieces having a first end and a second end and having at least one orifice passing through each of said side crosspieces near and substantially parallel to said first end and at least one orifice passing through each of said side crosspieces near and substantially parallel to said second end, a plurality of said elongated side crosspieces forming a left side of said chair and a plurality of said elongated side crosspieces forming a right side of said chair;

(c) at least one flexible cord passing through at least some of said orifices, said at least one flexible cord simultaneously acting to hold said crosspieces in alignment and suspension and acting as the suspension means for hanging said chair; and, (d) a plurality of spacers located between said side crosspieces forming said left side at a front located end thereof, and a plurality of spacers located between said side crosspieces forming said right side at a front located end thereof, said spacers having at least one orifice therethrough and in alignment with orifices of said side crosspieces;

wherein said lateral crosspieces and side crosspieces are arranged in the shape of a chair with their orifices aligned with one another and with said at least one flexible cord passing through at least some of said orifices and wherein said at least one flexible cord includes one flexible cord which passes down and through the orifices at one end of said left side forming portion of said side crosspieces, and through the orifices at one end of the lateral crosspieces forming said bottom, and up through the orifices at the second end of said left side forming portion of said side crosspieces and the orifices at one end of said lateral crosspieces forming said back, and then down through the orifices at one end of said right side forming portion of said side crosspieces, and the orifices at the second end of the lateral crosspieces forming the back and then the orifices at the second end of the lateral crosspieces forming the bottom and up through the orifices at the second end of said right side forming portion of said side crosspieces.

9. The hanging claims of claim 8 wherein said chair further includes:

at least one front crosspiece having a first end and a second end and having at least one orifice passing therethrough near and substantially parallel to said first end and at least one orifice passing therethrough near and substantially parallel to said second end.

10. The hanging chair of claim 9 wherein said at least one front crosspiece is located atop said side crosspiece and is adapted to be glidable vertically along said flexible cord to enhance chair access by a user.

11. The hanging chair of claim 8 wherein said lateral crosspieces forming said back of said chair and said side crosspieces are interleaved in alternating fashion to form an open lattice of crosspieces on said back and said sides of said chair.

12. The hanging chair of claim 8 wherein said spacers are separate pieces.

13. The hanging chair of claim 8 wherein said spacers are integrally formed with one or more of said side crosspieces.

14. The hanging chair of claim 8 wherein said crosspieces are made of one or more materials selected from plastic, wood and metal.

15. A hanging chair, which comprises:

(a) a plurality of elongated lateral crosspieces, each having a first end and a second end and having at least one orifice passing through each of said crosspieces near and substantially parallel to said first end and at least one orifice passing through each of said crosspieces near and substantially parallel to said second end, a portion of said plurality of crosspieces forming a back of said chair and another portion of said crosspieces forming a base of said chair;

(b) a plurality of elongated side crosspieces having a first end and a second end and having at least one orifice passing through each of said side crosspieces near and substantially parallel to said first end and at least one orifice passing through each of said side crosspieces near and substantially parallel to said second end, a portion of said side crosspieces forming a left side of said chair and a portion of said crosspieces forming a right side of said chair;

(c) at least one flexible cord passing through at least some of said orifices, said at least one flexible cord simultaneously acting to hold said crosspieces in alignment and suspension and acting as the suspension means for hanging said chair;

(d) a plurality of spacers located between said side crosspieces at a front located end thereof, said spacers having at least one orifice therethrough and in alignment with orifices of said side crosspieces; and, (e) at least one center spacer attached to the front located end of said chair and extending vertically between at least one front crosspiece and a lateral crosspiece so as to create a divider for legs of a user to prevent slipping forwardly by said user;

wherein said lateral crosspieces and side crosspieces are arranged in the shape of a chair with their orifices aligned with one another and with said at least one flexible cord passing through at least some of said orifices and wherein said at least one center spacer has an orifice therethrough with a flexible material cord therethrough fixedly connected to a crosspiece of said chair and movably attached to said at least one other crosspiece.

16. The hanging chair of claim 15 wherein said flexible material cord through said at least one center spacer is a stretchable cord which permits vertical movement away from said center spacers.

17. The hanging chair of claim 15 wherein said flexible material cord through at least one said spacer is detachably connected to at least one crosspiece.

18. The hanging chair of claim 15 wherein said at least one flexible cord includes one flexible cord which passes down and through the orifices at one end of said lateral crosspieces forming said back and the orifices at one end of the left side forming portion of said side crosspieces, and through the orifices at one end of the lateral crosspieces forming said bottom, and up through the orifices at the second end of said left side forming portion of said side crosspieces, and then down through the orifices at one end of said right side forming portion of said side crosspieces, through the orifices at the second end of the lateral crosspieces forming the bottom and up through the orifices at the second end of said right side forming portion of said side crosspieces and the orifices at the second end of the lateral crosspieces forming the back.

19. The hanging chair of claim 15 wherein there is one flexible cord which passes down and through the orifices at one end of said left side forming portion of said side crosspieces, and through the orifices at one end of the lateral crosspieces forming said bottom, and up through the orifices at the second end of said left side forming portion of said side crosspieces and the orifices at one end of said lateral crosspieces forming said back, and then down through the orifices at one end of said right side forming portion of said side crosspieces, and the orifices at the second end of the lateral crosspieces forming the back and then the orifices at the second end of the lateral crosspieces forming the bottom and up through the orifices at the second end of said right side forming portion of said side crosspieces.

20. The hanging chair of claim 15 wherein said at least one flexible cord includes two flexible cords and one passes through the orifices at both ends of a left side forming portion of said crosspieces and through the orifices at one end of said lateral crosspieces and the other passes through the orifices at both ends of a right side forming portion of said crosspieces and through the orifices at the second end of said lateral crosspiece.

21. The hanging chair of claim 15 wherein said crosspieces are made of one or more materials selected from plastic, wood and metal.

* * * * *